US005385456A

United States Patent [19]

Mancini

[11] Patent Number: 5,385,456

[45] Date of Patent: Jan. 31, 1995

[54] PUMP FOR HOT CHAMBER DIE CASTING OF CORROSIVE LIGHT ALLOYS

[76] Inventor: Flavio Mancini, Contrada delle Bassiche 37, Brescia, Italy

[21] Appl. No.: 67,321

[22] Filed: May 25, 1993

[30] Foreign Application Priority Data

May 26, 1992 [IT] Italy ..... BS92 A 000057

[51] Int. Cl.[6] ..... B22D 17/04

[52] U.S. Cl. ..... 417/510; 164/316; 92/162 R

[58] Field of Search ..... 164/304, 309, 316; 417/510, 437, 559; 92/162 R

[56] References Cited

U.S. PATENT DOCUMENTS

| | | | |
|---|---|---|---|
| 812,329 | 2/1906 | Daugherty | 164/316 |
| 1,039,173 | 9/1912 | Morris | 164/309 |
| 1,346,077 | 7/1920 | Carter | 164/316 |
| 1,458,482 | 6/1923 | Grey | 164/309 |
| 1,931,273 | 10/1933 | Sundstrom | 164/309 |
| 2,292,634 | 8/1942 | Hansen | 417/559 |
| 2,462,113 | 2/1949 | Lipson | 164/309 |
| 3,093,087 | 6/1963 | Hansen | 417/559 |
| 3,209,419 | 10/1965 | Deguchi et al. | 164/316 |
| 3,319,702 | 5/1987 | Hartwig et al. | 164/316 |
| 3,586,095 | 6/1971 | Fulgenzi | 164/316 |
| 3,814,170 | 6/1974 | Kahn | 164/309 |
| 4,091,970 | 5/1978 | Komiyama et al. | 164/316 |
| 4,408,651 | 10/1983 | Smedley et al. | 164/316 |
| 4,958,675 | 9/1990 | Kidd | 164/316 |
| 5,072,778 | 12/1991 | Fink | 164/316 |
| 5,082,045 | 1/1992 | Lambert | 169/316 |

FOREIGN PATENT DOCUMENTS

| | | | |
|---|---|---|---|
| 0114934 | 8/1984 | European Pat. Off. . | |
| 625439 | 6/1979 | France . | |
| 2405103 | 6/1981 | France . | |
| 56-023359 | 5/1981 | Japan . | |
| 1386780 | 3/1975 | United Kingdom | 164/316 |

OTHER PUBLICATIONS

European Search Report for European Patent Application No. EP 93 83 0225, Apr. 20, 1994 (1 page).

*Primary Examiner*—Richard A. Bertsch
*Assistant Examiner*—Peter Korytnyk
*Attorney, Agent, or Firm*—Panitch Schwarze Jacobs & Nadel

[57] ABSTRACT

A pump for the hot chamber die casting of corrosive light alloys including a body (2) wherein a cavity (3) is formed in which a piston (4) vertically reciprocates and on whose side wall (5) an opening (11) for the introduction of the molten alloy (1) and the mouth of a sprue (9) for the connection with the mold (10) are formed. The diameter of the piston (4) is smaller than that of the cavity (3) so that it may move without rubbing on the wall (5) as it is guided by a seal packing (6) detachably constrained to the mouth of the cavity (3), the opening (11) being closed during the compression of the alloy in the cavity (3) by a valve (12) controlled from outside through a lever (13).

7 Claims, 1 Drawing Sheet

PUMP FOR HOT CHAMBER DIE CASTING OF CORROSIVE LIGHT ALLOYS

FIELD OF THE INVENTION

The present invention concerns pumps for the injection die forming of metallic pieces and particularly for the hot chamber die casting of corrosive light alloys such as, for example, aluminum alloys.

BACKGROUND OF THE INVENTION

It is known that cold chamber pumps or hot chamber pumps can be used in the series production of precision casts by injection molding of non-ferrous metallic alloys such as of aluminum, zinc, magnesium, copper, etc. The use of cold chamber pumps, which are outside the crucible, in which the amount of alloy needed at every casting cycle is taken from the crucible and ladled into a non-heated cylinder, is subject to a series of serious drawbacks, such as the difficulty of dosing the amount of alloy, variations in the content of oxide which is taken from the molten alloy bath surface, irregular variations in the temperature of the alloy during the cycle, greater porosity of the pieces, etc.

Even if the use of hot chamber pumps, in which the injection pump is totally or partially immersed in the molten alloy, requires pumps of lower power and solves most of the above-mentioned problems yet it presents the great drawback that when said molten alloy at melting temperature is corrosive for the ferrous materials the members of the pumps are rapidly etched by it.

Therefore, it is apparent that the advantages offered by hot chamber pumps are such as to justify the continuous research of new corrosion-resistant materials, capable of assuring a sufficient life and reliability to the parts exposed to the contact with the corrosive alloys. Said materials are mainly obtained from alloys of various elements such as titanium, boron, silicon, carbon, chromium, aluminum itself and rarer elements such as yttrium, lanthanum, scandium, cesium, samarium, zirconium, etc. The processes used to obtain protective surfacings of alloys of said materials usually are sintering and slip casting, or the pieces themselves may be entirely made of anti-corrosion material. A number of examples of these corrosion-resistant alloys such as $TiB_2$, $ZrB_2$, TiC, $Si_3N_4$, $Y_2O_3$, $La_2O_3$, etc. are described in the U.S. Pat. Nos. 3,319,702 and 3,586,095 (Union Carbide), in the Japanese patents JP81.000.389, JP56.023.358, JP56.023.359 and JP56.023.360 (Toshiba Mach.), and in the Swiss patent CH625.439 (Injecta).

The aim of the research of alloys more and more corrosion-resistant is that of extending the operating life of the pump, mainly as far as the most critical members such as the piston and the cylinder are concerned, which are not only subject to the corrosion by the molten alloy, but they also have to withstand the abrasion caused by the motion of the piston sealably sliding in the cylinder. The play which occurs between piston and cylinder owing both to the thermal expansion and the surface corrosion is extremely damaging for the correct working of the pump. In fact, the introduction of the molten alloy into the cylinder usually takes place through an opening in the side wall of the cylinder which is closed by the piston in its downward stroke with the consequent impossibility of using low rigidity piston rings which would be damaged by the passage on the side opening.

In the above-cited Injecta patent a pump is disclosed having a piston whose lower end is cut at 45° so as to allow the inflow of the molten alloy into the cylinder without extracting completely the piston and without forming openings in the side wall of the cylinder, wherein, nonetheless, the piston must sealably slide, and therefore the problem of the coupling tolerances between piston and cylinder remains.

From the above it is apparent that in the prior art pumps special surfacings are needed for the critical coupling between piston and cylinder, in which account must be taken of the problems of thermal expansion, friction between the parts, corrosion of the contacting surfaces and possible oxide scales on said surfaces. The whole of these problems implies a shortening of the life of the above-mentioned critical members of the pump with consequent costs, both in terms of pieces replacement and machine stop times for the inspection and/or maintenance thereof.

The object of the present invention is to provide a pump for the hot chamber die casting of corrosive metallic alloys which is free from the above-described drawbacks thus allowing to considerably extend the nonstop working time of the machine.

This object is achieved by means of a pump having the features cited in claim 1.

SUMMARY OF THE INVENTION

The first and most apparent advantage of the pump according to the present invention is that of having eliminated the need of a perfect seal between the piston and the cylinder for the correct working of the machine. Therefore, the changes in the distance between the two parts in relative motion, caused both by the thermal expansion and the surface corrosion, do not compromise the functionality of the plant. In this way it is also possible to considerably extend the inspection and/or maintenance intervals of the plant.

A further advantage of the present pump is represented by the possibility of changing its displacement according to the production requirements without having to replace the whole pump, but simply by coupling pistons of greater or smaller diameter to the same cylinder.

BRIEF DESCRIPTION OF THE DRAWINGS

These and other advantages and characteristics of the pump according to the present invention will be apparent to those skilled in the art from the following detailed description of an embodiment thereof, reported as non limiting example, referring to FIG. 1, the only drawing annexed herewith, wherein said pump is shown in vertical cross-section.

DETAILED DESCRIPTION OF THE INVENTION

Figure 1:
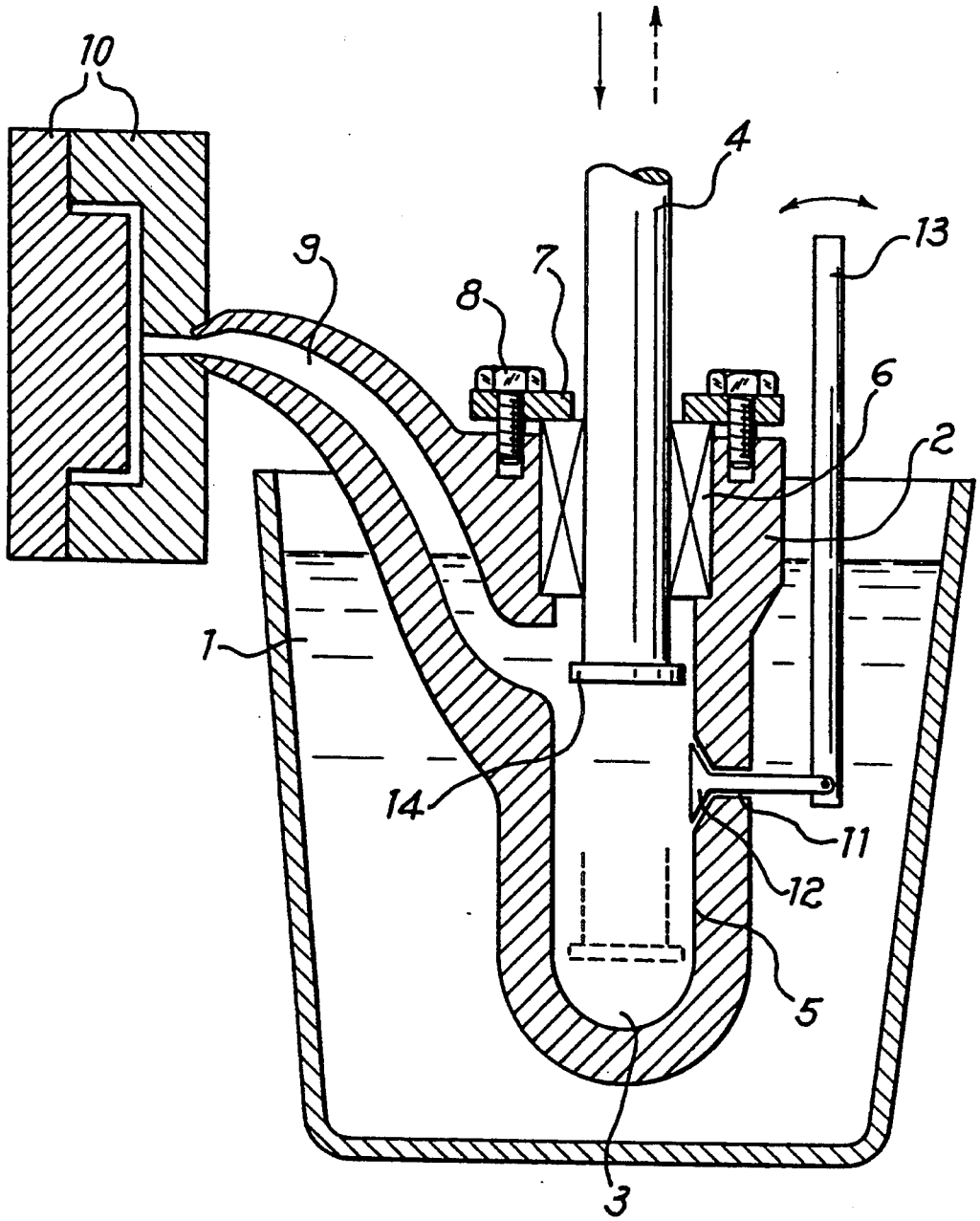

In FIG. 1 there is seen that the pump according to the present invention, immersed in the molten alloy 1 contained in a crucible, is essentially formed by a body 2 inside which a substantially cylindrical cavity 3 is formed wherein a piston 4 can vertically reciprocate. The diameter of the piston 4 is smaller than that of the cylindrical cavity 3, so that in its reciprocating motion it never comes into contact with the side wall 5 of said cavity 3, but it is guided by a seal packing 6 constrained at the upper mouth of the cavity 3 by means of a plate 7 and a series of through screws 8.

The mouth of the sprue 9 connecting the cavity 3 to the mold 10 is present on one side of the wall 5, while on the opposite side an opening 11 for the introduction of the molten alloy 1 is formed.

Contrary to prior art pumps, the opening 11 is not closed by the piston 4 in its downward stroke. Said opening is closed instead by a proper conical valve 12 which is externally controlled by means of a lever 13 driven, for example, by a jack. In this way, the sealing against the pressure exerted by the piston 4 is not carried out between the piston itself and the cavity 3, but only between the piston and the seal 6. The surface of the seal 6 in contact with the piston 4 never comes into contact with the molten alloy, and it is exactly thanks to this clever device that the sealing problems connected to the corrosion are solved. As clearly shown in FIG. 1, the lower edge of the seal packing 6, as well as the mouth of the sprue 9 and the opening 11 are below the level of the molten alloy 1 within the crucible, so that air cannot enter the cavity 3 at any step of the casting process.

It should be noted that the material of the seal 6 is sufficiently yielding to permit to take up the play which may occur with the piston 4 due to the surface corrosion thereof by simply adjusting the pressure of the plate 7 on the seal 6 by means of the screws 8, even during the operation of the plant. The vertical crushing of the seal 6 causes its expansion in the transverse direction and therefore its perfect adherence to the piston 4 and the pump body 2. The fact that the material of the seal 6 is sufficiently yielding to allow this taking up of the play does not compromise the guiding function carried out by the seal 6, since the distance between the piston 4 and the wall 5 of the cavity 3 allows to tolerate misalignments of the piston 4 with respect to the pump axis even of some millimeters, whereas in conventional pumps the tolerances are in the range of the hundredths of millimeters. The seal may possibly be formed by the superposition of three coaxial members of which only the central one is yielding and intended for the taking up of the play, while the other two members may be rigid in order to keep the piston 4 exactly along the axis, which piston may anyway be guided from above by the same outer device which provides its motion.

The piston 4 presents at its lower end a base 14 of a greater diameter than that of the rest of the piston. Said base 14 serves to take away therewith the seal 6 when the piston 4 is extracted from the pump body 2. This expedient makes the extraction of the seal 6 easier when it has to be replaced.

It is apparent that all the surfaces exposed to the contact with the molten alloy must be protected with proper surfacings of anti-corrosion materials such as those listed in the introductory part, or entirely made of said materials. Yet, the pump according to the present invention allows a greater freedom of choice of the material to be used thanks to the absence of rubbing between two surfaces both exposed to the corrosive action of the molten alloy. In this way it results possible to use even fragile materials, such as ceramics or the like, which instead would not be suitable to cover surfaces subjected to mechanical stresses. Since in the pump according to the present invention the piston 4 is subjected to pascalian pressure only in its reciprocating motion inside the cavity 3, it is possible to coat it with said ceramic materials and the like or make it entirely of said materials.

Obviously, the valve 12 may be of a shape different from the one described above, and it may be controlled not by an external device but automatically by the motion of the piston 4 which generates a cycle of positive and negative pressure inside the cavity 3.

Clearly, the above-described and illustrated embodiment is just an example susceptible of different changes, such as in the method of constraint of the seal 6 to the pump body 2, or in the control device of the valve 12 by means of a mechanism equivalent to the lever 13. The shape of the cavity 3 as well as the positions of the sprue 9 and of the opening 11 may also be somewhat changed, said characteristics not being strictly bound by the size and stroke of the piston 4, with consequent greater design freedom.

Therefore other additions and/or changes may be made to the pump of the present invention thus remaining within the scope of the invention.

I claim:

1. A pump for hot chamber die casting of corrosive light alloys comprising:

a body having a cavity formed therein, an opening for introducing a molten alloy into the cavity, and a mouth, the molten alloy within the cavity having a top surface;

a piston which vertically reciprocates within the cavity for compressing the molten alloy therein to raise the top surface of the molten alloy within the cavity;

a seal packing detachably constrained to the mouth of the body for guiding the piston, the piston having a diameter substantially smaller than a diameter of the cavity so that the piston moves within the cavity without coming into contact with a wall of the cavity;

a sprue interconnecting the cavity with a mold; and a valve for closing the opening in the body during compression of the molten alloy in the cavity;

wherein a lower edge of the seal packing and of the piston, a mouth of the sprue, and the opening into the body are located below the top surface of the molten alloy.

2. A pump according to claim 1, characterized in that the valve is controlled from a location external to the body.

3. A pump according to claim 1, further comprising a lever for controlling the valve and a jack means for driving the lever.

4. A pump according to claim 1, characterized in that the valve (12) is automatically controlled by the reciprocating motion of the piston (4).

5. A pump according to claim 1, characterized in that the seal (6) is constrained to the body (2) by means of a plate (7) fixed by a series of through screws (8).

6. A pump according to claim 1, characterized in that the piston (4) is provided at its lower end with a base (14) of a greater diameter than that of the rest of the piston.

7. A pump according to claim 1, characterized in that the outer surface of the piston (4) and of the wall of the cavity (3) is of ceramic material.

* * * * *